United States Patent [19]

Limbach

[11] Patent Number: 4,567,617

[45] Date of Patent: Feb. 4, 1986

[54] METHOD OF FITTING SKI BOOTS

[76] Inventor: Robert C. Limbach, 2001 Ferry Bldg., San Francisco, Calif. 94111

[21] Appl. No.: 645,507

[22] Filed: Aug. 30, 1984

[51] Int. Cl.[4] ..... A43D 9/00; A43B 7/14

[52] U.S. Cl. ..... 12/142 P; 12/142 N; 36/117; 36/93; 128/779

[58] Field of Search ..... 12/60, 1 R, 142 R, 142 N, 12/142 P; 128/779, 80 DB, 600, 601, 613, 596; 36/117, 119, 93, 88

[56] References Cited

U.S. PATENT DOCUMENTS

| | | | |
|---|---|---|---|
| 2,492,059 | 12/1949 | Ogden | 128/80 DB |
| 3,530,522 | 9/1970 | Kaufmann | 12/142 R |
| 3,711,880 | 1/1973 | Dalebout | 12/1 R |
| 3,739,498 | 6/1973 | Tessaro | 36/117 |
| 3,882,561 | 5/1975 | Hanson et al. | 12/142 P |
| 3,990,159 | 11/1976 | Borgeas | 36/101 |
| 4,120,064 | 10/1978 | Salomon | 36/93 |
| 4,416,292 | 11/1983 | Brown | 128/779 |
| 4,428,130 | 1/1984 | Perotto | 36/117 |
| 4,433,494 | 2/1984 | Courvoisier | 36/93 |
| 4,522,777 | 6/1985 | Peterson | 36/88 |
| 4,534,122 | 8/1985 | MacPhail | 36/88 |

FOREIGN PATENT DOCUMENTS

| | | | |
|---|---|---|---|
| 919088 | 9/1954 | Fed. Rep. of Germany | 36/119 |
| 483673 | 7/1917 | France | 128/80 DB |

*Primary Examiner*—Henry S. Jaudon
*Assistant Examiner*—Steven N. Meyers
*Attorney, Agent, or Firm*—Karl A. Limbach

[57] ABSTRACT

A method of fitting ski boots to a skier by standing the skier in the boots on orthotics with the skier's feet ankles and legs unconfined by the boots, recording the relative lateral locations of the skier's knees and boots, repeating the process with the skier's feet supported on the orthotics and confined by the boots, and adjusting the boots to provide the same relative lateral locations of knee and boot.

4 Claims, 9 Drawing Figures

METHOD OF FITTING SKI BOOTS

BACKGROUND OF INVENTION

This invention relates to a method of adjusting ski boots to the anatomy of an individual skier in order that the skier can achieve ideal performance from the boot.

Modern ski boots have a relatively flexible inner blader and a relatively rigid outer shell, and the outer shell has a foot portion which supports the skier's foot and a cuff portion which supports the skier's shin. The foot portion has a sole adapted to engage the ski and support surfaces designed to engage safety bindings. Some of the boots have the foot and cuff made from a single piece, but most boots have the foot and cuff made from different pieces connected by some means designed to control the relative position or movement of the two pieces.

Thus, when the skier's foot is supported firmly in the boot and the boot is supported on the ski, it is desirable to control the forwrd lean and canting of the skier's leg. Forward lean is measured in a plane which is longitudinal of the ski perpendicular to the ski's running surface, and control of forward lean is desirable to keep the skier's weight balanced and forward over the skis. Canting is measured in a plane which is transverse of the ski, and control of canting is important because changes in the canting angle determine whether the inside or outside edge of the ski predominates when the skier is running straight on a flat slope.

This invention relates to a method of adjusting the ski boot to the anatomy of the skier in order that canting can be controlled exactly so that the skier can have a perfectly balanced ski with neither inner or outer edge predominating over the other when the skier is running straight on a flat slope. The method can also be used to adjust the ski to provide a precise predetermined cant fitted to the skier's anatomy where the skier desires to have predominant inner edges, but a ski racer will generally perform better with neutral inner and outer edges, because a predominant edge adds drag.

Canting of ski boots has been controlled in the past by a variety of methods with varying degrees of inaccuracy. Thus, canting has been controlled by shimming, or shaving wedges from, ski boots until a plumb hanging from the skier's kneecap hangs over his big toe. Some ski boots are provided with a canting adjustment between the foot and cuff to permit the skier to adjust the canting angle to whatever angle feels best. Sometimes canting has been done by recording the location of a plumb under the skier's knee while the skier stands in ski boots from which the bladders have been removed, and then shaving wedges from the boots to obtain the same plumb locations when the skier stands in the boots with the bladders in place; where this method has been used, the boots have first been altered to align the cuff perpendicular to the foot portion of the boot removing any initial canting angle which has been built into the boot. These methods achieve varying degrees of accuracy and differing results with different kinds of boots.

SUMMARY OF INVENTION

In accordance with this invention, exact control of canting is achieved consistently with a wide variety of different ski boot designs. This is accomplished using an orthotic designed to correct the skier's natural stance. A variety of such orthotics may be used where the orthotic is medically designed to fit the skier's anatomy to a flat plane with a proper stance. The preferred orthotics are the orthotics prepared by the Peterson Sports Laboratories of Lake Placid, N.Y.

The skier's feet supported on orthotics are supported in the foot portions of the boots from which the bladders have been removed with the leg laterally unconfined. Preliminary alteration of the boot to eliminate canting angles is not absolutely necessary, so the method can be used with one piece boots and without changing the initial setting of a canting adjustment in such an adjustable boot. With the skier's feet thus supported and the feet spaced apart by the distance the skier normally uses during skiing, the lateral position of the skier's knee with respect to the foot portion of the boot is recorded.

Then the skier's feet are firmly supported on the orthotics in the boots with the bladders in place and with the boots at the same spacing to produce a second lateral location of the knee to each boot. In this step of the method, the orthotics are mounted inside the bladder where they are worn during skiing whereas the orthotics were mounted directly in the shell of the boot in the first step of the method.

Finally, the outer shells of the boots are altered to make the second lateral location equal to the lateral location recorded earlier.

The alteration of the shell of the boot can be accomplished by adjusting a canting angle adjustment mechanism if one is provided in the boot, or the alteration can be made by removing a wedge of material from the sole of the boot care being taken to adjust the surfaces of the sole and binding supports to their original relationships.

DETAILED DESCRIPTION

These and other features of the invention will be apparent from the following description taken with the attached drawings in which.

Figure 1:
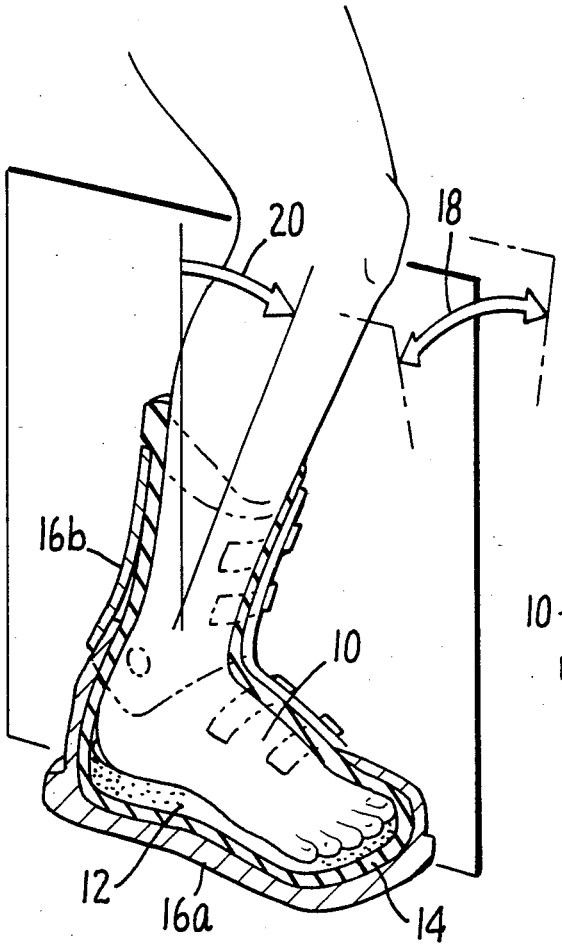
FIG. 1 is a perspective diagram illustrating a skier's foot in a ski boot with the forward lean and canting angles indicated.

Referring now in detail to the drawing, the skier's foot 10 is supported on an orthotic 12 inside the bladder 14 of a ski boot 16. The foot portion of the boot is indicated at 16*a*, and the cuff portion of the boot is indicated at 16*b*. The skier's leg is supported by the boot in a plane inclined to the vertical by the canting angle 18, and the leg is inclined in this plane by the forward lean angle 20.

In accordance with this invention, the boot is adjusted to the skier's stance as the skier's natural stance has been corrected medically by the orthotic in the following way. The bladders are removed from the boots and the skier stood in the boots on his orthotics. Note that with the bladders removed the boots are sufficiently loose around the skier's feet and legs so that the skier's feet, ankles and legs are unconfined by the boots. Both boots are used at the same time though only one boot is shown in the drawings, and the skier stands in the boots with his normal skiing foot separation and his normal skiing forward lean angle.

Figure 2A:
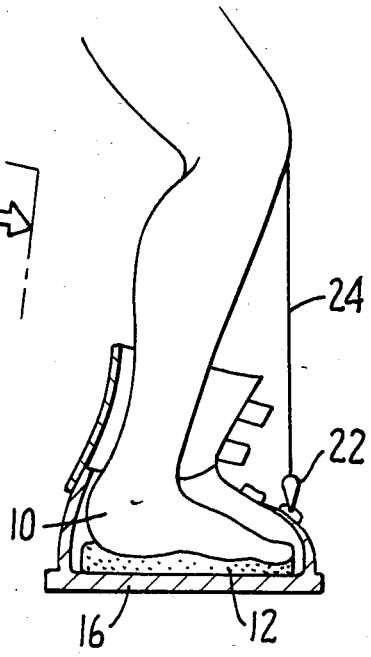
FIG. 2 is a pair of cross-sectional diagrams illustrating the first step of the method of this invention.
Figure 2B:
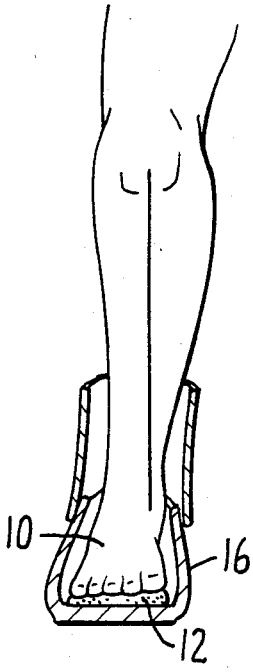

This condition is illustrated in FIG. 2, and in this condition the relative lateral location of the skier's knee and the boot is recorded. This can be done in a number of ways, but it can be done conveniently by suspending a plumb 22 from the skier's kneecap and making a mark on the boot where the plumb strikes. The plumb 22 may be suspended on a string 24, and the string is supported adjacent to a predetermined point on the skier's kneecap.

Figure 3A:
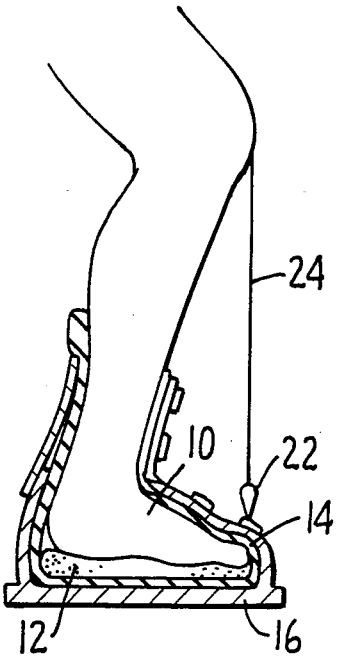
FIG. 3 is a pair of cross-sectional diagrams like FIG. 2 illustrating the second step in the method this invention.
Figure 3B:
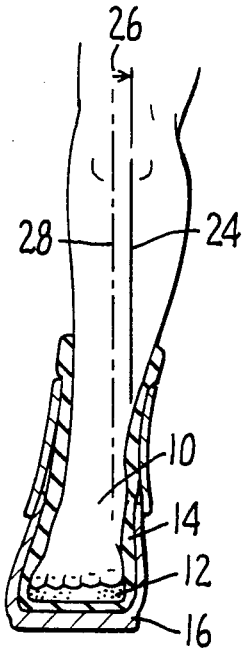
Figure 4A:
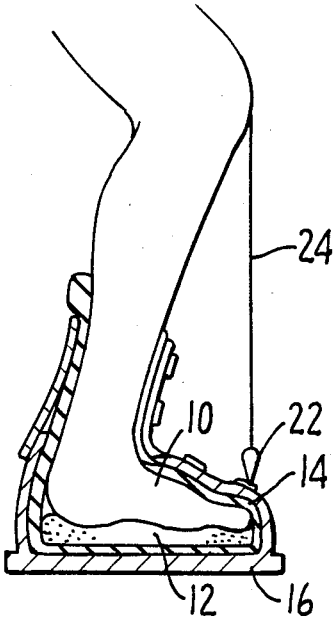
FIG. 4 is a pair of cross-sectional diagrams like FIGS. 2 and 3 illustrating the final step in the method this invention.
Figure 4B:
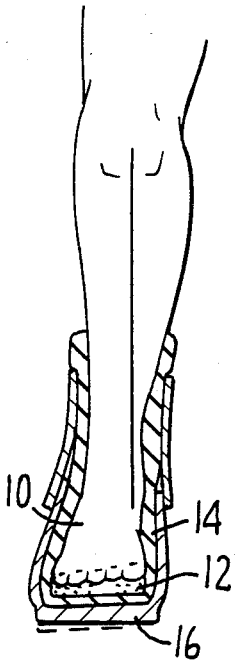

With the initial relative position of the knee and boot recorded, the process is repeated with the skier's feet and orthotics fully supported in the boots. Again both boots are used with the skier standing with the same foot separation and forward lean. As indicated in FIG. 3, the confinement of the boots will normally produce a different relative position of the foot and boot as indicated by the separation 26 between the string 24 and the vertical plane 28 through the mark made on the boot in the first step.

The change in relative lateral location of the knee and boot is noted, and the boots are adjusted to return the relative lateral location of the knee and boot to the original condition noted in step one. As explained above, this adjustment may be made by adjusting a canting adjustment in the boot if one is provided, and in that case the adjustment may be made by another person while the skier is standing in the condition of FIG. 2 with the adjustment continued until the condition of FIG. 3 is reached where the original relative lateral location of knee and boot is achieved.

One form of boot adjustment which may be used in this way is the adjustment mechanism shown in U.S. Pat. No. 3,739,498. Alternatively, adjustment can be made with the boots shown in FIGS. 5 and 6 which are sold as Lange Model ZT boots.

Figure 5:
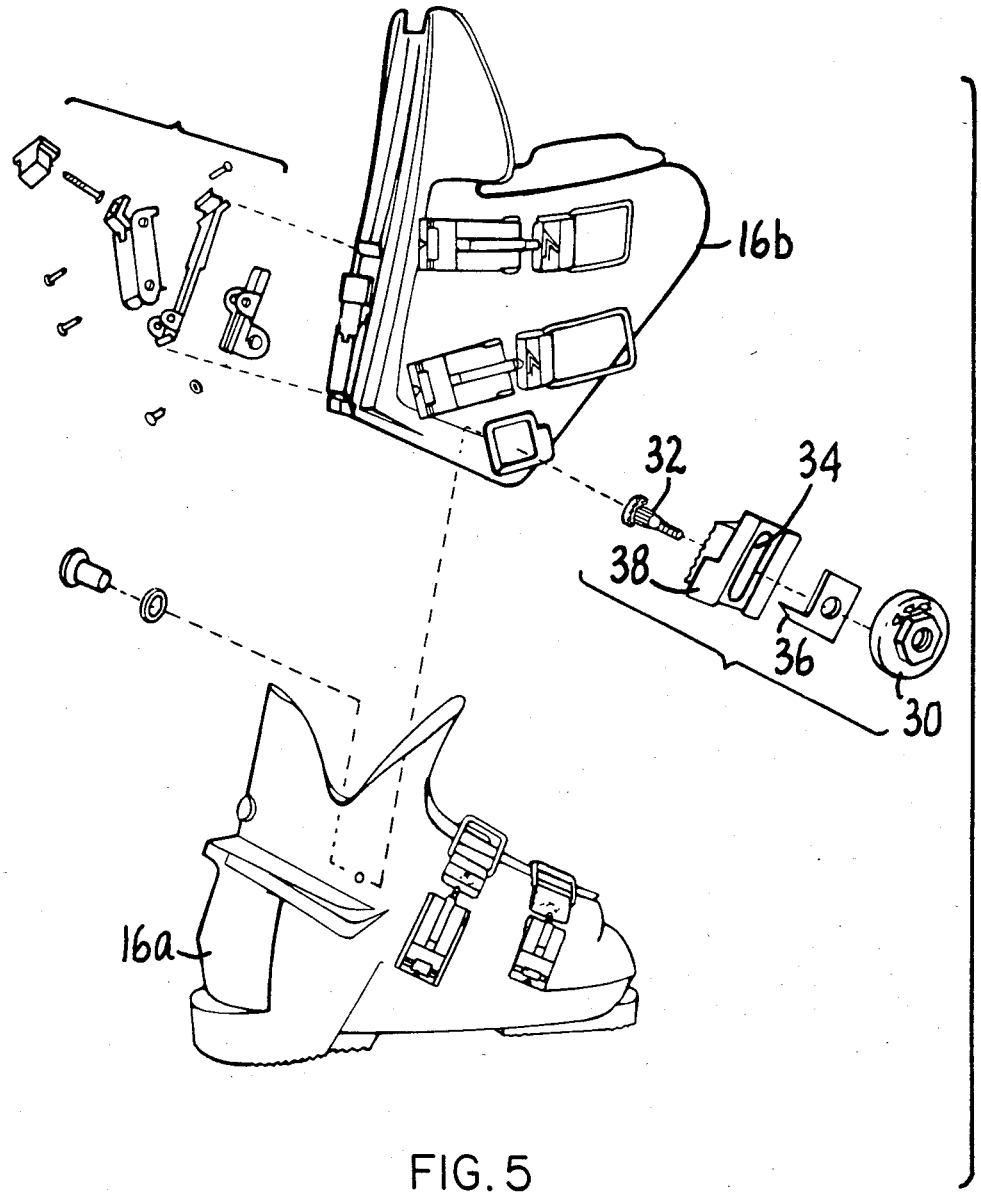
FIG. 5 is an exploded view of a prior art right boot which may be used in the method of this invention.
Figure 6:
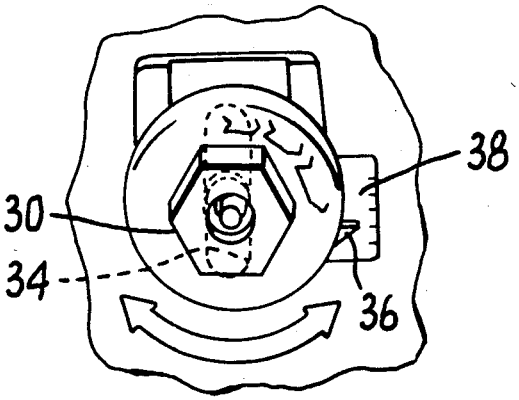
FIG. 6 is an elevational view of a portion of the left boot matching FIG. 5 with the parts assembled.

The canting adjustment in the boots of FIGS. 5 and 6 is used by loosening a nut 30 so that the cuff **16*b* can pivot, while pin 32 mounted in the foot portion 16*a*, moves in a slot 34 in the cuff 16*b*. A pointer 36 operates with a scale 38 to record the cuff adjustment, and the nut 30** is locked when the proper canting angle is obtained.

Where the skier's boots are not provided with a canting angle adjustment mechanism, the adjustment can be made by mechanical adjustment of the boot. For instance a wedge of material may be shaved from the sole of the boot with the magnitude of the wedge determined to be just sufficient to return the knee and boot to their original relative lateral locations. In this case the magnitude of the wedge can be determined by the use of calibrated shims under the boot in FIG. 2, and the wedge can be removed with a conventional planer.

Where the boots are not provided with an adjustment mechanism for the canting angle, and the angle is made by altering the boot as explained above, it may be desirable to remove any initial canting angle built into the boot if this can be done without injuring the boots. Thus, some ski boots are provided with a built in canting angle of three degrees on the assumption that three degrees is a good average canting angle for average skiers, and that angle can be removed easily on some boots simply by relocating the hinge pins between the foot and cuff portions of the boots.

I claim:

1. The method of adjusting the lateral canting of a ski boot of a skier where the boot has an outer shell and an inner removable bladder and where the skier has an orthotic adapted to correct the stance of the skier which method comprises:

standing the skier in a first condiiton on the orthotic in the outer shell of the boot with the bladder removed and recording the lateral location of the skier's knee with respect to the shell, standing the skier in a second condition on the orthotic in the ski boot while the bladder is supported in the shell with a second lateral location of the skier's knee with respect to the shell, and altering the outer shell of the boot to adjust the lateral location in the second condition to be the same as the lateral location in the first condition.

2. The method of claim 1 in which the altering step is performed by removing a wedge of material from the sole of the outer shell of the boot.

3. The method of claim 2 in which the outer shell has a foot portion adapted to support the skier's foot and a cuff portion adapted to support the skier's shin and the method further comprises the step of adjusting the cuff portion into alignment laterally perpendicular to the foot portion before performing the step of standing the skier in the first condition.

4. The method of claim 1 in which the outer shell has a foot portion adapted to support the skier's foot and a cuff portion adapted to support the skier's shin with adjusting means interconnecting the foot and cuff portions, and the altering step is performed by adjusting the adjusting means.

* * * * *